United States Patent [19]

Boets et al.

[11] Patent Number: 4,760,915

[45] Date of Patent: Aug. 2, 1988

[54] LIGHT-TIGHT FILM REEL PACKAGE

[75] Inventors: Marc J. Boets, Edegem; Raymond A. Heylen, Grobbendonk, both of Belgium

[73] Assignee: AGFA-Gevaert N.V., Mortsel, Belgium

[21] Appl. No.: 927,006

[22] Filed: Oct. 29, 1986

[30] Foreign Application Priority Data

Nov. 4, 1985 [EP] European Pat. Off. ..... 85201781.3

[51] Int. Cl.[4] ..... B65D 85/672

[52] U.S. Cl. ..... 206/303; 206/316; 206/391; 206/595; 206/597; 220/355

[58] Field of Search ..... 206/303, 316, 389, 391, 206/394, 393, 397, 398, 400, 408, 445, 599; 220/355, 356, 357, 358; 229/5.5, 5.8

[56] References Cited

U.S. PATENT DOCUMENTS

| | | | |
|---|---|---|---|
| 1,365,659 | 1/1921 | Carter | 206/397 |
| 1,925,565 | 9/1933 | Nelson | 206/408 |
| 2,335,766 | 11/1943 | Kinloch | 206/408 |
| 2,623,685 | 12/1952 | Hill | 220/355 |
| 3,357,626 | 12/1967 | Carpenter et al. | 229/5.5 |
| 3,532,210 | 10/1970 | Minion et al. | 206/408 |
| 4,480,748 | 11/1984 | Wind | 206/599 |

FOREIGN PATENT DOCUMENTS

| | | | |
|---|---|---|---|
| 0209510 | 1/1924 | United Kingdom | 220/355 |
| 0479059 | 1/1938 | United Kingdom | 229/5.5 |

*Primary Examiner*—Jimmy G. Foster
*Attorney, Agent, or Firm*—William J. Daniel

[57] ABSTRACT

A package containing a plurality of unexposed photographic film reels, which comprises a vertical mantle, a top and bottom lid with a peripheral groove and a sealing ring that is engaged by the corresponding extremity of the mantle, straps that vertically encircle the package to damp-tightly lock the lids to the mantle, and spacing means at the underside that allow the forks of an elevating mechanism to engage the package.

11 Claims, 4 Drawing Sheets

LIGHT-TIGHT FILM REEL PACKAGE

Figure 1:
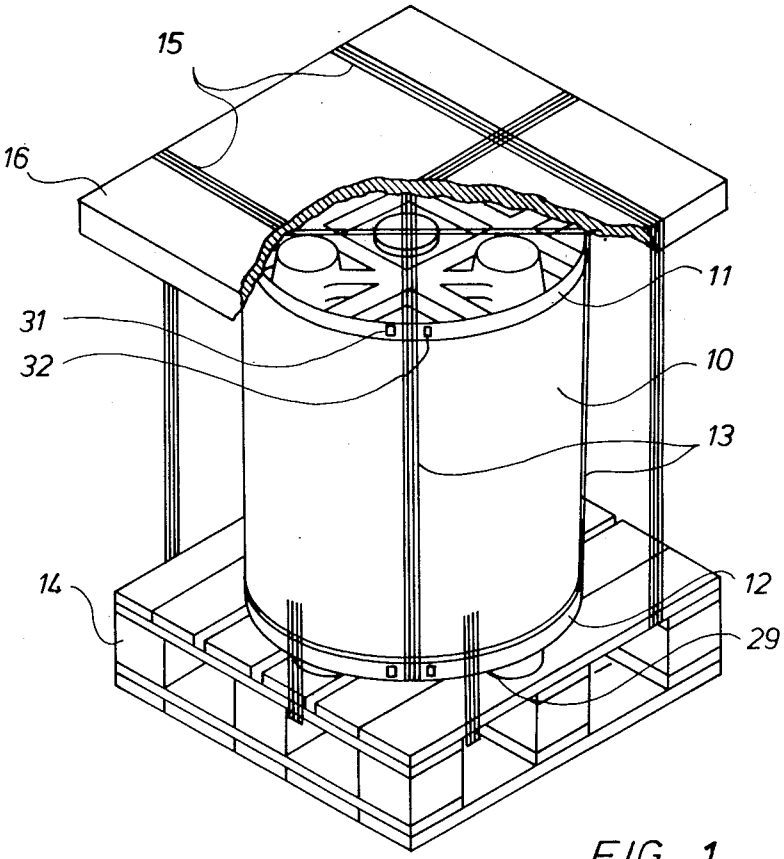

The present invention relates to a light-tight package containing a plurality of unexposed photographic film reels which are vertically stacked on top of each other.

Film packages of this type are used for the loading of cinefilm printers for the production of distribution copies from cinefilm.

According to one embodiment, the known packages comprise a vertical mantle, a top and a bottom, lid, straps vertically encircling the package to secure the lids on the mantle, a stack of unexposed film reels separated by interleaving means, a tube passing through the hubs of the film reels and axially centered in the mantle, and projecting spacers at the underside of the stack that allow entry of the forks of an elevating mechanism for the stepwise lifting of the stack of film reels.

The package, the weight of which may easily attain 140 kgs for 16 4000 ft film reels, is secured to a pallet whereby the package may be readily transported by means of a fork lift truck into the printing room. The package being deposited on a predetermined location in the printing room, the straps that secure the package to the pallet are cut and removed. The darkroom illumination is established and the package is opened to give access to the complete stack of film reels. The central tube is removed and an elevating mechanism, e.g. another fork lifting device, that engages the stack of films at the underside between the spacers is put into operation for lifting the stack until the upper film reel takes a position that is at the level of a reel discharge platform. The upper reel is then laterally slid from the stack and is received on the unwinding spindle of the printer. After the reel of film has been consumed, the elevator is controlled to raise the stack until the next film reel takes the position of the first one and, after the hub of the empty reel has been removed, this next reel is transferred horizontally towards the unwinding spindle, and so stepwise on.

The described film reel package is disclosed in Research Disclosure Bulletin of November 1982, pages 358 and 359, under the number 22324.

A disadvantage of the disclosed package is caused by the top and the bottom lid which are rather voluminous and which thereby occupy much space when removed, unless they are destroyed to get a smaller volume. A further unfavourable point is that the lateral walls of the lower lid must be folded down in order that the underside of the stack, and more, particularly a base with spacing ribs, become accessible for the introduction of the forks of the elevating mechanism. Finally, the plastic bag in which the stack of reels is wrapped to protect the unexposed films against light, moisture and dust, is difficult to remove from the stack. These points complicate the work in the dark room where the printing mostly goes on at a high rate.

In another form, known cardboard packages for the conventional hand-loading of cinefilm printers comprise a vertical mantle, a top and bottom lid, straps horizontally encircling the package to interlock the lids with the mantle, a stack of unexposed film reels that are individually light-tightly and damp-tightly wrapped, and a pallet at the underside of the package that allows the transport of the package by means of a fork lift truck. This type of package is marketed by Agfa-Gevaert N.V., Belgium, under the Tradename Box-Bin The individual damp-tight and light-tight wrapping of each film reel increases the cost price of the material in suchlike package.

Finally, there is known a prefabricated packing case that comprises a top and a bottom lid with one peripheral groove each, four lateral panels that can fit in said grooves, and straps for urging the two lids against the lateral panels. The packing case has the advantage that it can be delivered in a small volume to the end user, and that its height may easily be modified in accordance with the merchandise to be packed. A disadvantage of the packing case is that it is difficult to make it air-tight, since this requires the application of sealing means between the distinct panels, apart from the sealing of panels in the grooves, and this destroys the suitability of the packing to be reduced to a small volume. The mentioned packing case is disclosed in FR-A 2 554 086.

It is the object of the present invention to provide an improved package with reels of unexposed cinefilm for the automated as well as for the hand loading of cinefilm printers that is cheaper to manufacture and that can be more readily handled in the darkroom.

According to the present invention, a package with a plurality of unexposed photographic film reels, comprising a vertical mantle, a top and bottom lid, straps vertically encircling the package to secure the lids on the mantle, a vertical stack of unexposed film reels and spacing means at the underside that allow entry of the forks of an elevating mechanism for the lifting up of the stack of film reels, is characterised thereby that the top and the bottom lid are moulded components having a peripheral groove, that the mantle and the lids of the package are damp-tight and light-tight, and that sealing means is provided for forming a damp-tight and light-tight seal between a peripheral groove and a corresponding end portion of the mantle engaged in the groove.

The form of package described above has the advantage that the individual wrappers for the film reels need provide only a protection against light and not against moisture since the moisture barrier is formed by the sealing, of course, results in between the lids and the mantle of the package. Opening of the package means a destruction of the moisture barrier, but this is no drawback as in practice the contents of an opened package are used within a few hours for the described application. The protection of the individual film reels against light is obtained by a wrapping material that is cheaper than a material that is also damp-tight.

Moreover, a light-tight wrapping needs no hermetic seal, and it may thus be obtained by the folding back of a flap of the wrapping and keeping the folded flap in place by a tape or the like.

The peripheral groove of each lid is preferably determined by wall sections that have a height that is notably greater than the width of the groove, for instance from 4 to 10 times larger. The peripheral walls get thereby a notable height whereby the stiffness of the lid is increased. This is favourable with a view of a uniform distribution of the forces that are induced in the lid by the straps that pass over the peripheral rim of the lid.

According to a preferred embodiment of the invention, the spacing means are integral with the bottom lid, whereby the functions of package lid and of means for engageably supporting the stack, are combined with each other. In this way, a package can be transported e.g. by a fork lift truck from a storage accomodation towards the printing room, and there be taken over by another fork lift that is arranged for positioning the stack in front of the printer and for stepwise lifting of the—then opened—package in order to remove the film reels in succession from the stack.

For the described operation, the spacing means of the package may be in the form of feet that allow entry of the forks of the fork lifts.

The lids may be designed to nest when empty, and in case the top lid is identic to the bottom lid, both lids may nest whereby an optimum use of the available floor space for empty packages may be obtained.

In case of packages with equal top and bottom lids, and with spacing means in the form of feet, such feet may be designed in such a way that their supporting surfaces show recesses and protrusions that may co-operate with corresponding potrusions and recesses of an adjacent foot so that two or more packages that are placed on top of each other are interlocked by their co-operating feet.

Figure 2:
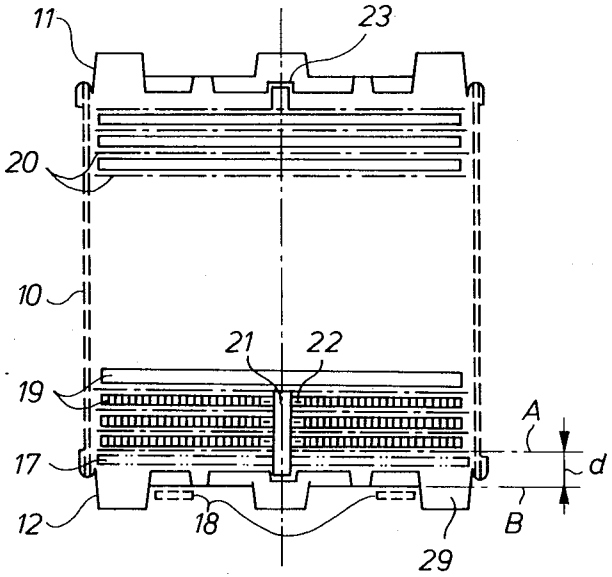
Figure 3:
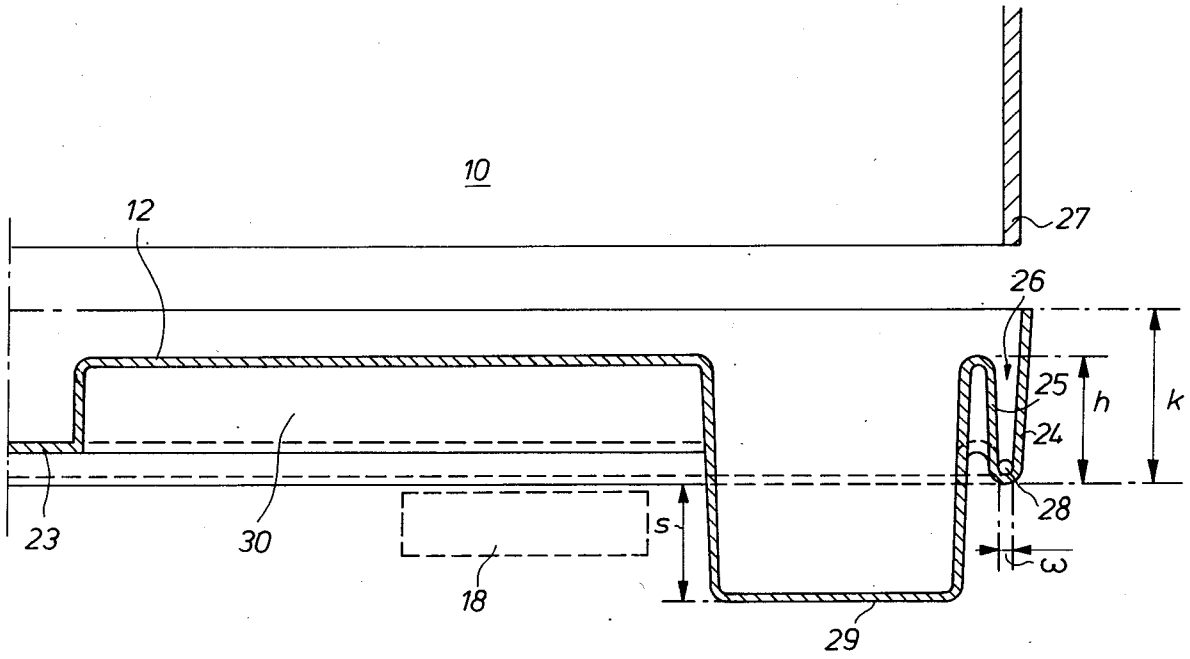
Figure 4:
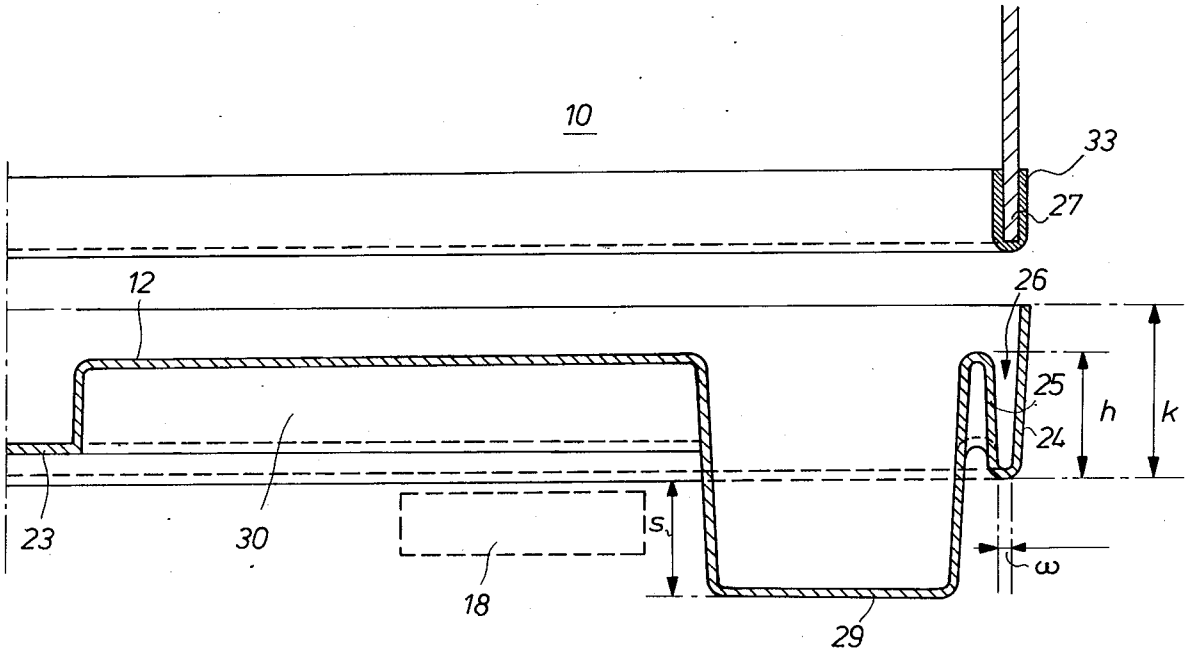

The package according to the invention will be described hereinafter by way of example with reference to the accompanying drawings wherein :

FIG. 1 is an isometric illustration of one embodiment of a package according to the invention, FIG. 2 is a vertical cross-section of the package according to FIG. 1, FIG. 3 is a detail of the cross-sectional view of FIG. 2, and FIG. 4 is a detail of a modified sealing between the mantle and a lid.

Referring to FIG. 1 which illustrates one embodiment of a package according to the present invent package comprises a drumlike mantle 10, a top lid 11 and an identical bottom lid 12, and straps 13 vertically encircling the top and bottom lid, and light-tightly and damp-tightly interlocking them with the mantle. The package may be secured to a pallet 14 by means of straps 15 that encircle a plate 16 that is placed on top of the package.

The cross-sectional view of FIG. 2 illustrates the internal arrangement of the package, the straps being omitted. The bottom lid 12 is provided with a spacer disc 17, the purpose of which is to determine the bottom level of the stack of reels, indicated by the broken line A, with respect to the bottom level B of the lid, which is the surface to be is engaged by the forks of an elevating mechanism that can transport the package and stepwise lift the stack into a special unloader station for the automated loading of the reels in a cinefilm printer.

The forks of the elevating mechanism are illustrated by the blocks 18 in broken lines.

The disc 17 was made from expanded polystyrene with a density of approximately 30 $kg.m^{-3}$.

On the disc 17 there are stacked a plurality of reels of cinefilm 19 that ar separated from each other by interleaving foils 20.

The film reels are kept centered in the package by means of a rod 21 that passes through the hubs 22 of the reels, see the lowermost reels which have been illustrated in cross-section, and through corresponding openings in the interleaving foils. The ends of the rod fit in a corresponding central recess 23 in each lid. In the present example the rod was formed by a PVC tube with a sufficient rigidity to maintain the stack of film reels in the central position. The interleaving foils 20 were made of PET with a thickness of 0.1 mm, both sides of which were coated with an antistatic layer.

An enlarged sectional view of a portion of the bottom lid 12 of the package is illustrated in FIG. 3. The lid has an outer peripheral wall 24 and an inner peripheral wall 25 that together define a peripheral groove 26 into which the end portion 27 of the mantle 10, which has been illustrated in a remote position, can fit. A sealing ring 28 is provided in the bottom of the groove and is kept in place through it own elasticity.

The lid has four feet, such as the foot 29 illustrated, that are spaced over 90 angular degrees and that provide a spacing between the bottom of the lid and the floor that allows the forks 18 of an elevator to get under the lid.

The lid is further provided with a plurality of ribs, such as the illustrated rib 30, that increase the stiffness of the lid.

Finally, there is illustrated at the left-hand side of the section of FIG. 3 the recess 23 which serves for the axial centering of the rod 21 in the package.

The peripheral walls that determine the peripheral groove 26 have a height h, respectively k, that is notably larger than the width w (measured near the bottom) of the groove. The advantage of these relatively large flanges is that they considerably increase the stiffness of the lid. This feature is important since in the illustrated example the lid is pressed by the straps on four points only onto the mantle.

In the case of a weak lid, it could be doubtful whether there would be sufficient contact pressure on the sealing ring at peripheral locations between the straps.

It can be seen on FIG. 3 that all upstanding wall portions of the lid are slightly slanting. This feature is a requirement per se for the unmoulding of the lid from the mould, but it is advantageous also for the stacking of the lids, and in th1s way nesting of the lids of empty packages may considerably reduce the required floor space in the printing premises. The lids may be moulded by vacuum-forming, injection-moulding, spray or hand lay-up moulding, etc. The lids may be manufactured from thermoplastics, thermosettings, either or not reinforced by suitable fibers, etc.

The mantle of the package may be made from various materials, but excellent results have been obtained by fibreboard mantles that were lined at the innerside with a foil that itself was a sandwich of three layers, namely an aluminium layer, a PE layer, and a paper layer.

The straps 13 and 15 may be made from known materials such as high-tensile steel, plastics or textiles.

The correct position of the straps 13 may be determined by lugs such as 31 and 32 that are provided on the outer peripheral wall of the lids, see FIG. 1, but it is clear that the lids may as well be provided with grooves, recesses or other deformations that determine an exact location for the straps.

The handling of the described package may be as follows. The package as illustrated in FIG. 1 is taken by a fork truck from a storage accomodation and transported towards the printing room. There the straps 15 are cut and the film package is taken from the pallet by a smaller type of fork lift (that may be hand-operated) and placed in front of an unloader section for the printer. The darkroom illumination is established, the straps 13 are cut, the top lid and the mantle are removed, and the central rod is taken out. The stack of film reels is then ready for the succesive removal of the different film reels from the stack, as described hereinbefore.

The following example illustrates a package that was made in accordance with the present invention.

Top and bottom lid : made from ABS by vacuum-forming
initial wall thickness: 5 mm
height k: 25 mm
height h: 20 mm
groove width w: 5 mm
distance d: 44 mm
separation s: 50 mm
Mantle: made from cardboard by helix-winding
thickness: 5 mm
outer diameter: 670 mm
height: 660 mm
Sealing ring 28: foamed polymer with closed cell structure, with a
width of 5 mm
Contents of package: 16 reels of 6000 ft, 35 mm film
Interleaving foils: circular polyester foils with a thickness of 0.1 mm
Total weight of the package: 210 kgs
Pallet: usual 4-way-entry, timber pallet.

The moisture-tightness of the package was tested as follows. A test bag containing approximately 2 kgs of a hygroscopic salt was included in an empty package, and then the package was closed and kept for four days in room where the atmospheric conditions were as follows. Temperature : 36° C., relative humidity: 90 %. The amount of moisture that was absorbed by the test bag during the test was determined by subtracting the initial weight of the bag from the end weight. This resulted in an amount of 0.05 g of absorbed water damp which is considered as an excellent result.

It will be understood that the package according to the invention is not limited to the described embodiment.

The package may also be arranged for being directly gripped by a fork lift truck for its loading and unloading, and its transport from a storage accomodation towards the printing room. The forks of a fork truck being usually heavier than the forks of the elevating mechanism used in the printing room, it will be necessary in such case to increase the height s of the feet of the bottom lid in order to allow direct engagement of the bottom lid by a fork truck. A satisfactory height for the feet in such case is obtained for s=100 mm.

In case pallet loading yet is used, different packages may be secured to one pallet, and in case different packages are placed onto each other, the feet may be designed to interlock as described in the introduction of the specification.

The mantle of the package may be made from materials other than cardboard, such as plastic, composite materials, etc.

The two lids need not be identic to each other. For instance, in the case of a bottom lid with feet that allow direct engagement of the bottom lid by a fork truck, the height of the feet becomes so important that it May be indicated to make the top lid different from the bottom lid, and more particularly, to provide no feet at all on the top lid. It may be interesting in such case to design one type of lid that can be used for the top as well as for the bottom of the package, and that allows feet to be fitted thereto (for the lower lid) by any known means such as adhesive, rivets, shrink-fitting, etc.

The package may be secured to a pallet by means other than straps, e.g. by means of enveloping taking the form of shrink-wrapping, stretch-wrapping, etc.

The seal between the lids and the mantle may occasionally be supplemented by the application of a self-adhesive tape over the outer peripheral wall of the lids and the adjacent zone of the mantle.

The sealing ring 28 need not necessarily be a separate element, but it may also be formed by pouring or injecting a suitable polymerizable compound into the groove, and thus forming the ring in situ.

Further, the sealing may also be performed by a resilient lining that is provided on the rims of the mantle. This is illustrated in FIG. 4 which is identic to FIG. 3, except that the ring 28 has been omitted, and a strip of self-adhesive tape 33 with a closed cell structure, has been provided on both sides of the rim 27 of the mantle 10. In the present case, the strip had a width of 50 mm, and a thickness of 1.6 mm, so that the sealing height was approximately 22 mm. It was shown that the sealing thus obtained was as effective as the one obtained with the sealing ring 28 described hereinbefore.

The lids and/or the mantle may be disposable items, but they may be also arranged for repeated use.

Finally, the manageability and the stiffness of the new package are such that it may be used for the packaging of more than 16 film reels, and for film reels having larger diameters.

In case the new filmpackage is used in a non-automated loading apparatus, the rod 21 is omitted from the package, and the film reels are individually wrapped in a light-tight bag that need no damp-tight sealing, and that therefore may be sealed by simply backfolding of a flap of the bag. The package may be used in such application, the mantle remaining in place on the lower lid, since this prevents the occasional falling over of the stack of film reels.

The mantle of the package may have the form of a square with rounded off corners. In this way the access into the opened package is facilitated for the operator because more space is available between the film reels and the adjacent corner section of the mantle. The lids in such package are of course in accordance with such non-circular form of the mantle. A package with a square-like form may be provided with four straps encircling the lid and the mantle, namely near each corner. In this way, the lids are contacted at eight points whereby the forces of the straps become better distributed along the perimeter of the lid.

It will be understood that also a circular package may be provided with more than two encircling straps.

We claim:

1. A package containing a plurality of unexposed photographic film reels, comprising a vertical tubular mantle, a top and bottom lid, wrapping strips vertically encircling the package to secure the lids to the mantle, a vertical stack of unexposed film reels within the mantle, and spacing means at the package ends that allow entry of the forks of an elevating mechanism for the lifting up of the stack of flim reels, characterised in that the top and the bottom lid are moulded components having a peripheral groove corresponding to the cross-sectional shape of said tubular mantle, each of said top and bottom lids and said tubular mantle being formed of material that is impervious to light and moisture, said peripheral grooves opening interiorly of the package for insertion therein of the opposite end margins of said tubular mantle to form detachable tongue and groove connections therebetween, and sealing means for forming a light- and moisture-tight seal between said grooves and the mantle margins inserted therein.

2. A package according to claim 1, wherein the sealing means is in the form of a resilient bead that is provided in the peripheral groove of the lids.

3. A package according to claim 1, wherein the sealing means is the form of a resilient lining of the rims of the mantle.

4. A package according to claim 1, wherein the mantle has a circular cross-section.

5. A package according to any of claim 1, wherein the film reels are individually wrapped in a light-tight envelope.

6. A package according to claim 5, wherein said spacing means are in the form of feet projecting from the bottom face of the lid, and allowing entry under the lid of the forks of a fork lift truck.

7. A package according to claim 6, wherein the lids are made from plastic.

8. A package according to any of claim 1, wherein the mantle is made from fibreboard that is covered at the innerside with a damp-tight lining.

9. A package according to any of claim 1, wherein the film reels are separated from each other by interleaving means, and wherein a tube passes through the hubs of the film reels for axially centering them in the package.

10. A package according to claim 1, which is releasably secured to a pallet.

11. A package according to claim 1, wherein the depth of said peripheral grooves is 4–10 times the radial thickness of the mantle margins inserted therein.

* * * * *